US005850234A

United States Patent [19]

Kneezel et al.

[11] Patent Number: 5,850,234

[45] Date of Patent: Dec. 15, 1998

[54] INK JET PRINTHEAD WITH IMPROVED OPERATION

[75] Inventors: Gary A. Kneezel; William G. Hawkins, both of Webster; Peter J. John, Rochester, all of N.Y.

[73] Assignee: Xerox Corporation, Stamford, Conn.

[21] Appl. No.: 784,632

[22] Filed: Jan. 21, 1997

[51] Int. Cl.[6] ..... B41J 2/175; B41J 29/377

[52] U.S. Cl. ..... 347/18; 347/43; 347/85

[58] Field of Search ..... 347/18, 67, 65, 347/85, 43

[56] References Cited

U.S. PATENT DOCUMENTS

| | | | |
|---|---|---|---|
| Re. 32,572 | 1/1988 | Hawkins et al. | 156/626 |
| 4,463,359 | 7/1984 | Ayata et al. | 347/56 |
| 4,601,777 | 7/1986 | Hawkins et al. | 156/626 |
| 4,638,337 | 1/1987 | Torpey et al. | 347/65 |
| 4,675,693 | 6/1987 | Yano | 347/63 |
| 5,017,941 | 5/1991 | Drake | 347/18 X |
| 5,066,964 | 11/1991 | Fukuda | 347/18 |
| 5,459,498 | 10/1995 | Seccomme | 347/18 |

FOREIGN PATENT DOCUMENTS

| | | | |
|---|---|---|---|
| 63-37953 | 2/1988 | Japan | B41J 3/04 |
| 3-208649 | 9/1991 | Japan | B41J 2/01 |

*Primary Examiner*—Joseph Hartary

[57] ABSTRACT

An ink jet printhead is disclosed which has improved printhead cooling thereby improving operating efficiency. The printhead is constructed so that the manifold bringing ink from an ink reservoir into an ink inlet to the printer directly contacts the thermally conductive surface of the substrate in which the heater elements are formed- The cooler ink removes some of the accumulated heat from the heater substrate and is subsequently ejected. In one embodiment the printhead comprises an upper channel substrate which is bonded to a lower heater substrate which is formed with a ledge which extends past the rear face of the channel substrate. The channel substrate has an ink inlet formed into its rear face and adjacent to an extended portion of the heater silicon surface. An ink reservoir brings ink to the printhead via an ink manifold which is sealed against the exposed silicon surface and against the side of the ink inlet. In a second embodiment, the formation of an ink inlet at the rear face enables the construction of a compact multicolor side-shooting printhead with 2 rows of nozzles.

4 Claims, 8 Drawing Sheets

INK JET PRINTHEAD WITH IMPROVED OPERATION

BACKGROUND OF THE INVENTION

This invention relates to thermal ink jet printing and, more particularly, to a thermal ink jet printer with improved operation enabled by an ink inlet design which provides increased ink cooling of the printhead and reduced air bubble entrapment within the printhead.

In current thermal ink jet printers, a printhead includes one or more ink-filled channels, such as disclosed in U.S. Pat. No. 4,463,359 to Ayata, et al. and U.S. Patent Re. 32,572 Hawkins, et al. Both of these patents are hereby incorporated by reference. At one end, these channels communicate with a relatively small ink supply chamber. At the opposite end, the channels have an opening referred to as a nozzle. A thermal energy generator, for example, a resistor, is located in each of the channels a predetermined distance from the nozzles. The resistors are individually addressed with a current pulse to momentarily vaporize ink in the respective channels and, thereby, form a bubble. As the bubble grows, the ink bulges from the nozzle, but it is contained by the surface tension of the ink as a meniscus. As the bubble begins to collapse, the ink still in the channel between the nozzle and bubble starts to move towards the collapsing bubble causing a volumetric contraction of the ink at the nozzle resulting in the separation of the bulging ink as an ink droplet. The acceleration of the ink out of the nozzle while the bubble is growing provides momentum and velocity to the droplet in a substantially straight line direction towards a recording medium, such as paper.

U.S. Pat. No. 4,601,777 to Hawkins, et al discloses several fabricating processes for ink jet printheads; each printhead being composed of two substrates aligned and bonded together. One part is substantially a flat lower heater substrate which contains on the surface thereof a linear array of heating elements and addressing electrodes, and the second part is an upper channel substrate having at least one recess anistropically etched therein to serve as an ink supply manifold when the two parts are bonded together. A linear array of parallel grooves are formed in the second part, so that one end of the grooves communicate with the manifold recess and the other ends are open for use as ink droplet expelling nozzles. Many printheads can be simultaneously made by producing a plurality of sets of heating element arrays with their addressing electrodes on, for example, a silicon wafer and by placing alignment marks thereon at predetermined locations. A corresponding plurality of sets of channels and associated manifolds are producing in a second silicon wafer and the two wafers are aligned, bonded together, and diced into separate printheads.

The ink droplet ejecting performance of thermal ink jet printheads is temperature dependent. Some of the energy from the electrical pulses to the resistive heaters is converted to kinetic energy of the ink droplet, and some of the energy is carried off by the droplet in the form of thermal energy. However, and typically, most of the energy results in heating of the silicon material comprising the heater substrate. The bottom of the heater substrate is bonded with thermally conductive adhesive to a heat sink. Unless special measures are taken to remove heat from the heat sink (such as by water cooling), the substrate accumulates thermal energy results in a gradual rise of the heat sink temperature. This temperature rise results in a corresponding rise in the temperature of the heater substrate and the ink. As a result of the self-heating of the printhead, the volume of ink ejected in each droplet becomes greater due to the higher energy content of the ink, as well as the lower viscosity of the ink. To some extent this is beneficial: because of the larger drop mass and higher velocity, more kinetic and thermal energy is carried away from the printhead by the ink, so that it becomes more efficient in cooling the printhead. However, the increased drop volume due to self-heating has adverse effects on print quality. The increased spot size resulting from the larger ink droplets leads to printing characteristics (e.g. optical density, color hue and saturation, and text character width) which are not uniform from print job to print job. Furthermore, since the drop generator must be sized to give sufficient drop volume at lower printhead temperatures, the increased drop volume due to self-heating gives rise to too much ink on the paper, resulting in increased intercolor bleed and excess moisture. For excessive amounts of self-heating, so much ink may be expelled from the channel that a significant amount of air is allowed to enter from the nozzle surface. Since the air bubbles do not condense (as vapor bubbles do), they interfere with ink flow and can result in jet misfiring, which produces white streaks in the printed page.

One method devised to compensate for printhead temperature variations and the thermal effects created by the temperature variations is to modify the electrical pulses to the droplet ejecting heating elements in response to the temperature of the printhead to keep the droplet volume, and thus spot size, more constant regardless of printhead temperature, and also to suppress air ingestion. The electrical pulses are generally modified by varying the electrical pulse width and/or amplitude.

SUMMARY OF THE INVENTION

It is a first object of the present invention to provide a thermal ink jet printhead which is designed to improve the effectiveness of cooling of the printhead by the ink.

It is another object of the invention to provide a thermal ink jet printhead whose improved design minimizes the entrapment of air bubbles therein.

These and other objects of the invention are realized, in an ink jet printhead of the type disclosed in the patents referenced supra, by changing the location of the ink inlet to the printhead. The current design supplies the ink from an ink reservoir through an external manifold and into a manifold interior to the printhead. Once within the printhead the ink flow path includes right angle turns which lead to bubble entrapment at the rear of the channels.

According to one aspect of the present invention, the location of the ink inlet to the channel substrate is changed from the top of the channel substrate to the side of the channel substrate immediately adjacent to the surface of the adjacent lower heater substrate. The exterior ink manifold is designed to introduce the ink to the inlet along capillary flow paths which are in direct contact with the heater substrate surface; thus, there is a heat transfer from the heater substrate to the relatively cooler ink which, although it is subsequently heated, is quickly ejected. This modification to the prior art printhead is accomplished through changes in the orientation-dependent etching process. A revised design results in a more direct ink path internal to the printhead minimizing stagnant zones where air bubble entrapment typically occurs.

According to a second aspect of the invention, the inventive concept disclosed above enables formation of a layered color printhead where two printheads, one printing in black and the other in multi colors such as magenta, yellow, and cyan are joined together.

In prior art printers such as, for example, that shown in FIG. 1 of U.S. Patent Re. 32,572, referenced supra, a plurality of individual printheads are mounted on a scanning carriage. The printheads are aligned parallel to each other; each printhead separated from an adjacent printhead by an ink tank mounted so as to supply ink to the ink inlet at the top surface of the channel plate. In a carriage type of printer having multiple parallel printheads, it is advantageous to minimize the distance between the rows of nozzles, as this minimizes the required printing overscan, and thereby enables a smaller printer footprint. By using the improved ink inter-connection of the invention, it becomes possible to stack and bond a black and multi-colored printhead to form a composite printhead without requiring connection to individual substrates and ink tanks and with a minimum nozzle row to nozzle row distance. In one embodiment, a black only printhead is fabricated with the improved ink inlet formed in the side of the channel substrate. An ink supply, which in the prior art would be between the two printheads, is then located behind the printheads. The multi-colored printhead consisting of a channel substrate bonded to a heater substrate is then bonded to the top surface of the black printhead channel substrate with ink inlets conventionally formed at the top of the multi-colored printhead channel substrate. This stacked relationship reduces the distance between the nozzle rows ejecting black ink and the nozzle rows ejecting the colored inks.

More particularly, the invention relates to an ink jet printer for recording images on a recording medium, the printer comprising:

at least one ink jet printhead having internal ink channels in communication with an ink inlet formed in the rear face of the printhead, the channels terminating in nozzles formed in the front face of the printhead, and an array of heater elements formed on a thermally conductive silicon heater substrate surface and positioned within said channels;

electrical inter-connections between said heater elements and a power source for selectively sending electrical signals to said heater elements, heating the elements and ink in the adjacent channels, causing ink to be ejected from associated nozzles onto the recording medium; and an ink reservoir for supplying ink to said printhead through an ink manifold sealed against the ink inlet, the manifold having an opening formed therethrough, and wherein the ink, as it flows into the ink inlet, directly contacts the thermally conductive heater substrate surface, thereby providing cooling of said substrate.

The invention also relates to a color ink jet printer for recording images on a recording medium, the printer comprising:

at least a first ink jet printhead having internal ink channels in communication with an in inlet formed in the rear face of the printhead, the channels terminating in a first nozzle row formed in the front face of the printer, and an array of heater elements formed on the thermally conductive silicon heater substrate surface and positioned within said channels;

electrical inter-connections between said heater elements and a power source for selectively sending electrical signals to said heater elements, heating the element and ink in the adjacent channel, causing ink to be ejected from an associated nozzle onto the recording medium;

an ink reservoir for supplying black ink to said first printhead through an ink manifold sealed against the ink inlet, the manifold having an opening formed therethrough so that the ink, as it flows into the ink inlet, directly contacts the thermally conductive heater substrate surface, thereby providing cooling of said substrate;

at least a second ink jet printhead bonded to the top surface of said first printhead, said second printhead having a plurality of internal groups of ink channels, each ink channel group being in connection with a separate ink inlet formed on the top surface of the second printhead, each group of ink channels terminating in the nozzle rows formed on the front face of the second printhead, the second printhead having groups of heating elements positioned within said channel groups;

an ink reservoir and manifold for supplying ink of a selected color into said separate ink inlets whereby each group of ink channels is filled with ink of a different color; and electrical inter-connections between said heater element groups and a power source for selectively sending electrical signals to said heater element groups, heating said elements in said groups and heating the ink in the associated channel groups thereby causing ink of a selected color to be ejected from the associated nozzle group onto the recording medium.

DESCRIPTION OF THE INVENTION

Figure 1:
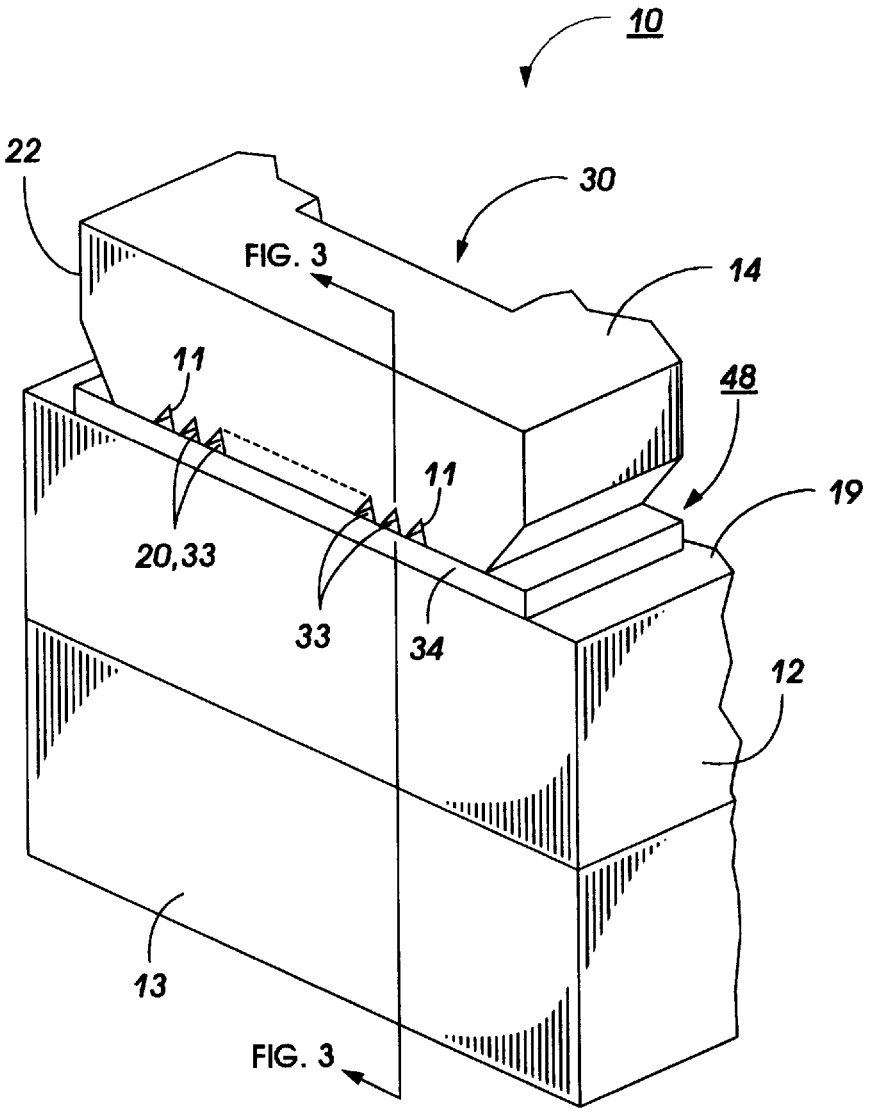
FIG. 1 PRIOR ART
FIG. 1 is an enlarged schematic isometric drawing of a prior art printhead which includes a channel substrate having an ink inlet on the top surface.
Figure 2:
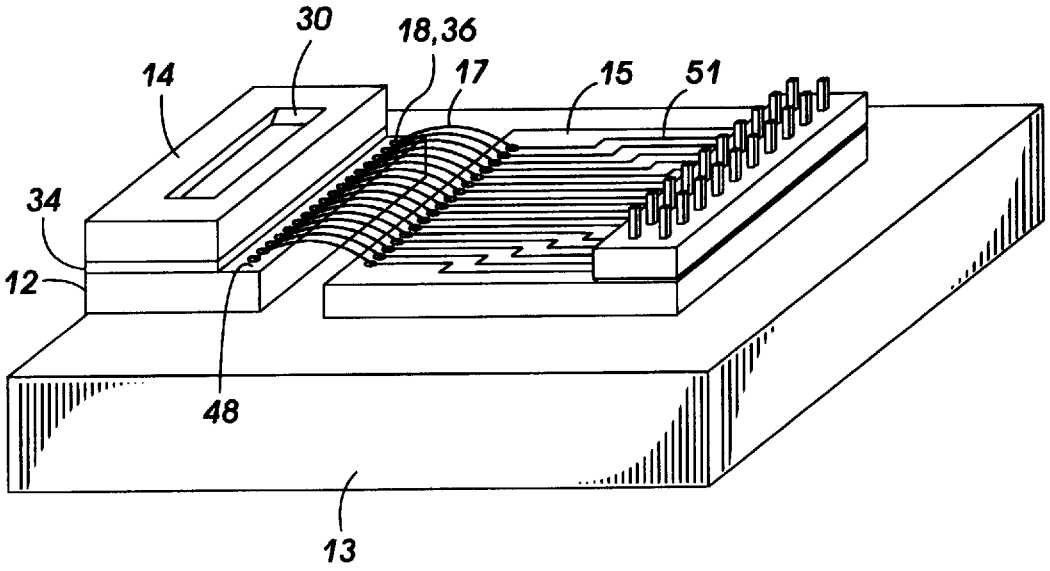
FIG. 2 is a top-perspective view of FIG. 1.
Figure 3:
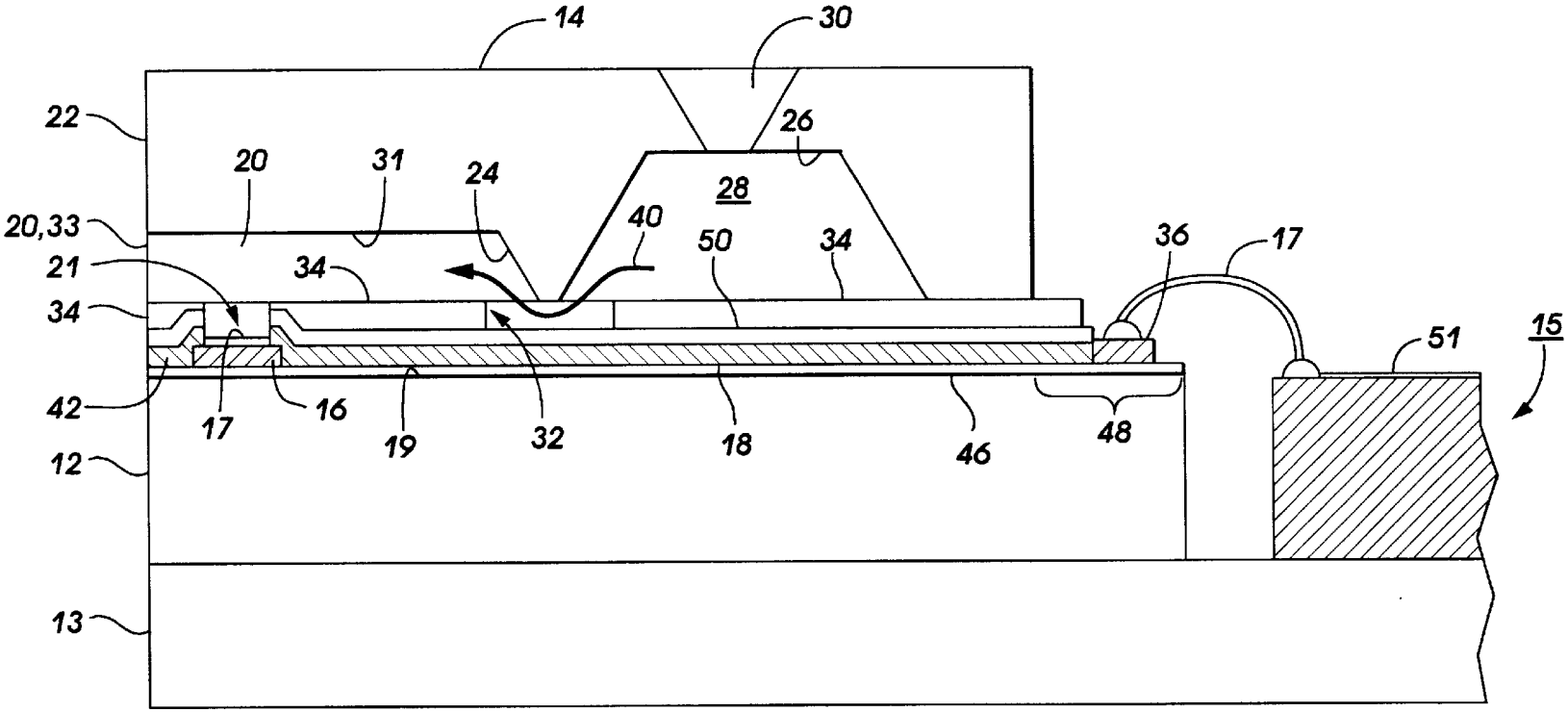
FIG. 3 is an enlarged cross-sectional view of FIG. 1 as viewed along Line 3—3.

FIGS. 1–3 are views of a prior art printhead 10 of the type wherein a first lower silicon substrate, or heater substrate 12, and a second upper silicon substrate, or channel substrate 14, are bonded together to form the printhead. The heater substrate 12 has heating elements (resistors) 16 and addressing electrodes 18 patterned on the surface 19 thereof. Channel substrate 14 has parallel grooves 11 formed in the bottom surface which extend in one direction. When the channel substrate is bonded to the heater substrate 12, channels 20 and nozzles 33 are formed at front face 22.

The other end of grooves 11 terminate at slanted wall 24 (FIG. 3). The floor 26 of internal recess 28 which is used as the internal ink supply manifold for the capillary-filled ink channels 20, has an inlet 30 therethrough for use as an ink fill hole. The bottom surface 31 of the channel substrate is aligned and bonded to the heater substrate 12 so that a respective one of the plurality of heating elements 16 is positioned in each of the channels, formed by the grooves and the heater substrate. Ink enters the manifold formed by the recess 28 through inlet 30 and, by capillary action, fills the channels 20 by flowing through an elongated recess 32 formed in a thick film insulative layer 34. The ink at each nozzle 33 forms a meniscus, the surface tension of which prevents the ink from weeping therefrom. The addressing electrodes 18 on the heater substrate 12 terminate at pads 36. The channel substrate 14 is smaller than that of the heater substrate in order that the electrode terminals or pads 36 are exposed and available for wire bonding to the electrodes on a daughter board on which the printhead die module 10 is permanently mounted. The thermal ink jet die module (composed of heater substrate 12 bonded to channel substrate 14) is bonded directly to a heat-sink substrate 13, and adjacent to a daughter board 15 (also bonded to the heat-sink substrate), prior to wire bonding for electrical interconnection. Layer 34 is a thick film organic passivation layer sandwiched between upper and lower substrates. This layer is etched to expose the heating elements 16 which have previously been covered by a protective layer 17, thus placing the heating elements in a pit 21. Layer 34 is etched to form the elongated recess 32 to enable ink flow between the manifold 28 and the ink channels 20. In addition, the thick film insulative layer 34 is etched to expose the electrode terminals.

FIG. 3 is a cross-sectional view of FIG. 1 taken along view Line 3—3 through one channel. FIG. 3 shows how the ink flows from the manifold 28 and around wall 24 of the groove 20 as depicted by arrow 40. As is disclosed in U.S. Pat. No. 4,638,337 to Torpey et al., whose contents are hereby incorporated by reference, a plurality of sets of heating elements 16 and their addressing electrodes 18 are patterned on a polished surface of a (100) silicon wafer. Prior to patterning, the multiple sets of printhead electrodes 18, the resistive material that serves as the heating elements, and a common return 42, the polished surface of the wafer is coated with an underglaze layer 46 such as silicon dioxide. The common return and the addressing electrodes are typically aluminum leads deposited on the underglaze and over the edges of the heating elements. The common return and addressing electrode bonding pads 36 are positioned at pre-determined locations to allow clearance for wire bonding to the electrodes 51 of the daughter board 15, after the channel substrate 14 is attached to make a printhead. A passivation layer 50 provides an ion barrier which protects exposed electrodes from the ink.

In the printhead shown in FIGS. 1–3, both the heater substrate and channel substrate are made of silicon. As has been described, the heater logic and drivers may also be formed on the heater substrate based on well developed silicon integrated circuit fabrication technology. Similar techniques are available to integrate circuitry on the channel substrate. Channel substrates are formed by techniques disclosed, for example, in U.S. Pat. No. 4,638,337, referenced supra.

With reference to FIGS. 1, 2, and 3, electrical interconnection between the heater substrate 12 and the daughter board 15 is by bonding of wires 17 therebetween. The bonding is made possible by dicing over the rear portion of channel substrate 14 to form a ledge portion 48 which contains the pads 36.

Figure 4:
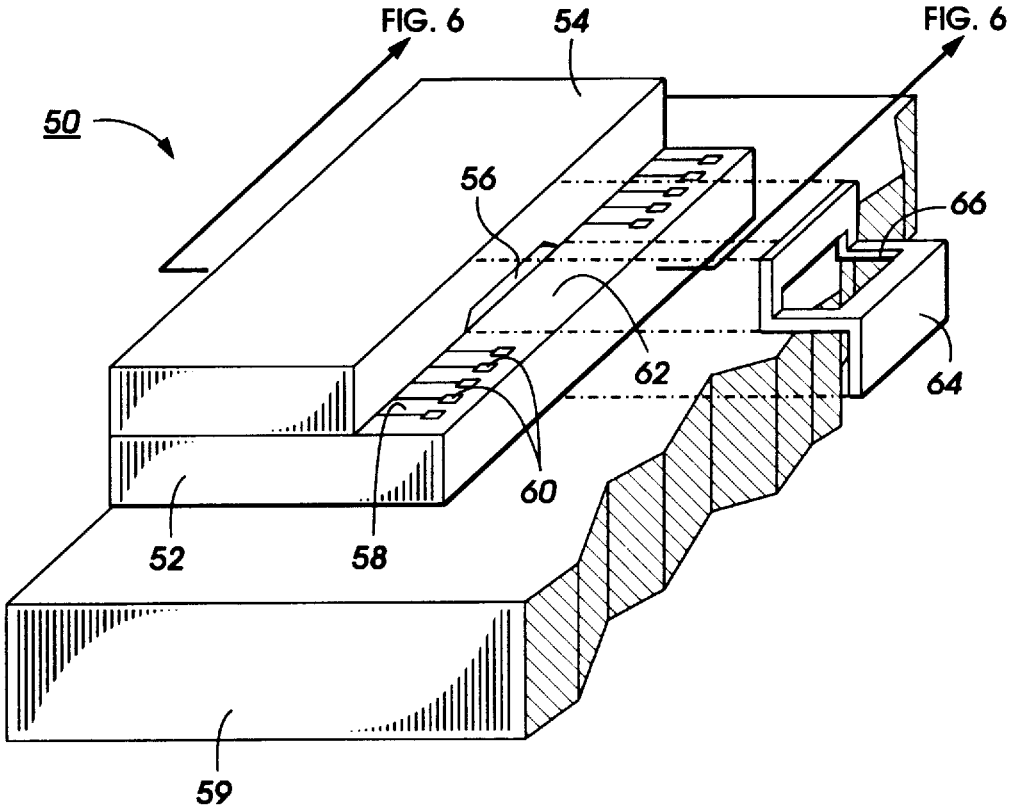
FIG. 4 is a modification of the printhead of FIG. 1 showing the ink inlet formed in the side of the channel substrate adjacent to the heater substrate's surface.

According to a first aspect of the invention, the prior art printhead is modified so as to bring ink into the printhead in a region where it can make direct contact with the silicon heater substrate, rather than being thermally insulated by an organic passivation layer such as layer 34 shown in FIGS. 2 and 3. FIG. 4 shows a simplified view of a printhead 50 comprising a heater substrate 52 bonded to a channel substrate 54. Printhead 50 differs from printhead 10, shown in FIGS. 1–3, by forming ink inlet 56 at the rear of channel substrate 52 just above a ledge 58 formed at the heater substrate top surface. The addressing electrodes 57, (see also FIG. 5) are connected to pads 60, which are concentrated at the sides of ledge 58 and away from the central portion of the ledge.

Figure 5:
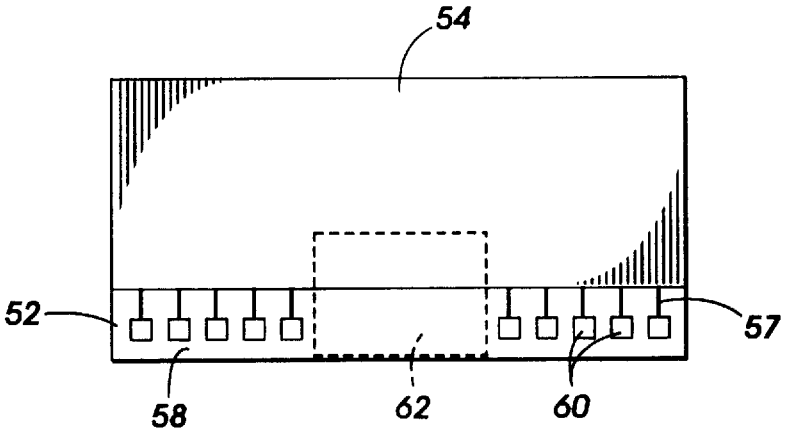
FIG. 5 is a top view of the heater substrate of FIG. 4.

The thermally insulating organic passivation layer (typically 30 micron thick layer of polyimide) and all circuitry has been removed from a region 62 denoted by dotted lines in FIGS. 4 and 5, leaving the thermally conductive silicon surface of substrate 52 exposed in that area. An ink reservoir (not shown) is then mounted so as to cause a stepped ink container manifold 64 to overlie region 62. An opening 66 in the manifold must at least overlap the ink inlet 56 and may also allow ink to contact that portion of region 62 which is located on ledge 58. Ink flows from the ink reservoir through opening 66 into the channel substrate manifold via ink inlet 56. A sealing gasket material (not shown, but conventional in the art) seals manifold 64 to the heater substrate ledge 58, and also around the sides of inlet 56. The heater substrate is bonded to a heat sink substrate 59 substantially similar to the heat sink substrate 13 shown in FIGS. 1–3.

Figure 6:
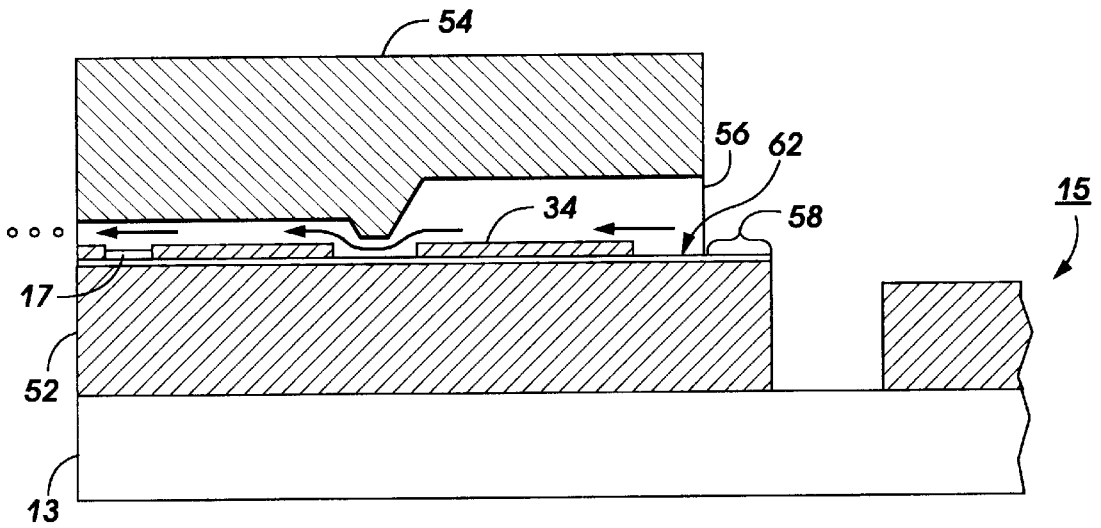
FIG. 6 is an enlarged cross-sectional view of the central region of the printhead in FIG. 4.

It will be appreciated from the above description that ink moving into the channel substrate through opening 66 will directly contact the surface of the heater substrate in region 62, absorbing heat from the substrate. The ink will be subsequently ejected from the printhead, removing the heated ink. As shown in FIG. 6, the ink path through the printhead is direct (relative to the FIGS. 1–3 embodiment), thus presenting fewer traps for air bubbles.

For cooling efficiency it is desirable to have region 62 (from which the organic passivation layer has been patterned away) to be as large as possible. However, if region 62 contains no circuitry, then the larger region 62 is, the larger the overall die size must be, and consequently the higher the printhead cost will be. Rather than removing all circuitry from region 62, it is possible to overcoat any remaining circuitry with an electrically insulating but thermally conductive layer such as 0.2 micron thick silicon nitride and a thermally conductive but ink resistant layer such as 0.5 micron thick tantalum. As long as the thermally insulating organic layer 34 is windowed away from region 62, the cooling efficiency will be improved over the prior art design.

Figure 7:
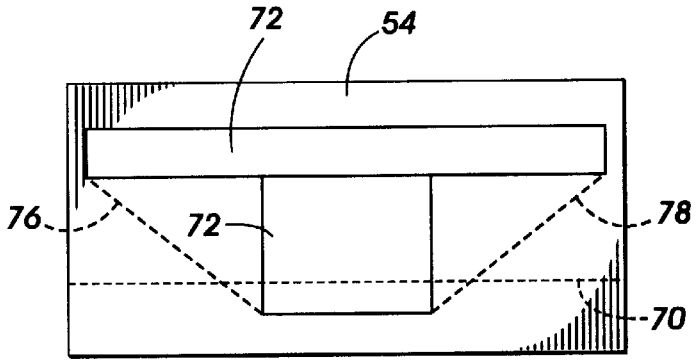
FIG. 7 is the channel substrate of FIG. 4 showing the etched cavities forming the ink inlet and flow path.

The ink inlet can be formed by a etch process delineated in FIG. 7. FIG. 7 shows the top of channel substrate 54. The ink inlet is composed of etched cavities, the rearmost of which is opened up by the dicing cut (horizontal dashed Line 70), which exposes the heater substrate ledge 58. The mask for etching might, for example, look like two solid rectangles 72, 74. In a (100) silicon wafer, an orientation dependent etching process will tend to etch a large rectangle which extends all the way to the left, right, and upper edges of the upper rectangle 72, and to the bottom edge of the lower rectangle 74. By stopping the etch before completion, the dotted lines 76, 78 become two of the boundary edges. The channels are not shown, but would be in the regions corresponding to the heater resistors on the heater substrate.

There is considerable design freedom on the rest of the ink delivery system to the printhead. The external manifold can, for example, extend over the top of channel substrate 54 to allow for larger ink volume, or the manifold can remain very thin in order to allow close packing of printheads, e.g. in a color printer. Typically, the manifold would widen out after making clearance for the wire bonds. Also the manifold would contain pins to align it to the heat sink and printhead. Typically the ink sealing gasket material would not provide the main structural bond of the manifold to the rest of the printhead, but that function would be provided on other manifold surfaces. Also, since the sealing surface is less wide than the printhead, this system is applicable to buttable printhead arrays, as well as to single printheads.

Figure 8:
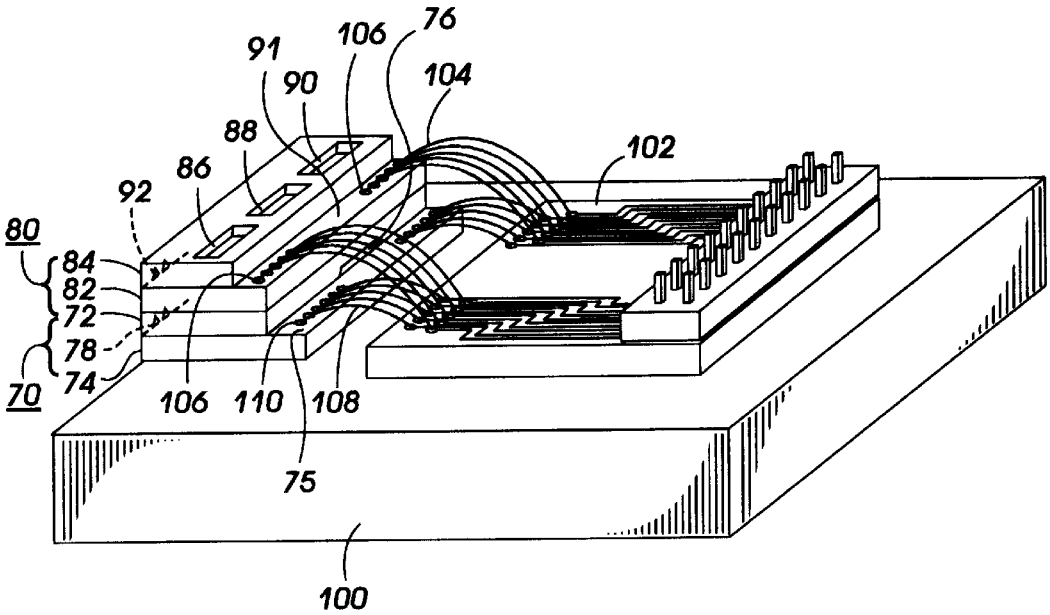
FIG. 8 shows a color printhead comprising a black printhead with a side ink inlet bonded to a color printhead with a top ink inlet.
Figure 9:
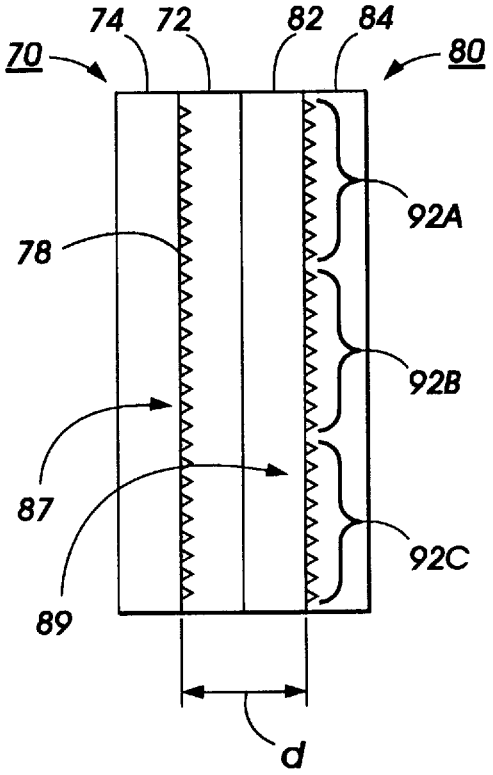
FIG. 9 is a front face view of the printhead in FIG. 8.

According to a second aspect of the invention, the printhead 50 shown in FIG. 4 can be combined with a second multi-colored printhead to form a compact side-shooting printhead assembly with two rows of nozzles. The side location of the ink inlet permits the heater substrate of a color printhead to be bonded directly to the channel substrate of a black-only printhead formed with the side ink inlet. This configuration places the rows of nozzles of the black and color printheads at a shorter distance than was possible with the composite printheads of the prior art. This feature is shown with reference to a color printhead 70, shown in FIG. 8. A first printhead 70 is fabricated as described in the description supra with a channel substrate 72 being bonded to a heater substrate 74, the channel substrate etched as shown in FIG. 7, and formed with ink inlet 76 adjacent to the heater substrate surface. Internal manifolds and resistors are not shown, but it is understood that a plurality of resistors, one in each channel, are pulsed to cause ink droplets to be ejected from nozzles 78 arranged along row 87. A second color printhead 80 is conventionally formed as in the prior art so as to have a plurality of internal sections, one section associated with a particular color. Printhead 80 includes a heater substrate 82 bonded to the top of channel substrate 72, and a channel substrate 84 bonded to the top surface of heater substrate 82. Channel substrate 84 has three ink inlets 86, 88, 90, each supplying a colored ink into the corresponding section of the channel substrate. Each section of printhead 80 has an associated group of resistors, with each resistor positioned in a corresponding channel. Ink ejecting nozzles 92 are formed in a row 89 as three groups (92A, 92B, 92C, FIG. 9), each group ejecting ink of a pre-determined color as supplied through the corresponding inlet. The color printhead assembly comprising printheads 70, 80 is connected to heat sink 100. Also mounted on heat sink 100 is daughter board 102. Electrical connections to the color printhead 80 are made by wires 104 connected between paths 106 formed on ledge 89 and daughter board 102. Electrical inter-connection to the black printhead 70 is made by wires 108 connected between paths 110 and the daughter board. All wire-bond pads are positioned away from the center of ledge 75 on heater substrate 74 to make room for the ink inlet 76. As shown in FIG. 9, the nozzle row 87 of the black printhead 70 is at a distance (d) from the nozzle row 89 of printhead 80, d being less than the prior art configuration. The distance d would be approximately 1 mm, whereas in prior art parallel printheads, the distance d would typically be 10 to 30 mm.

Figure 10:
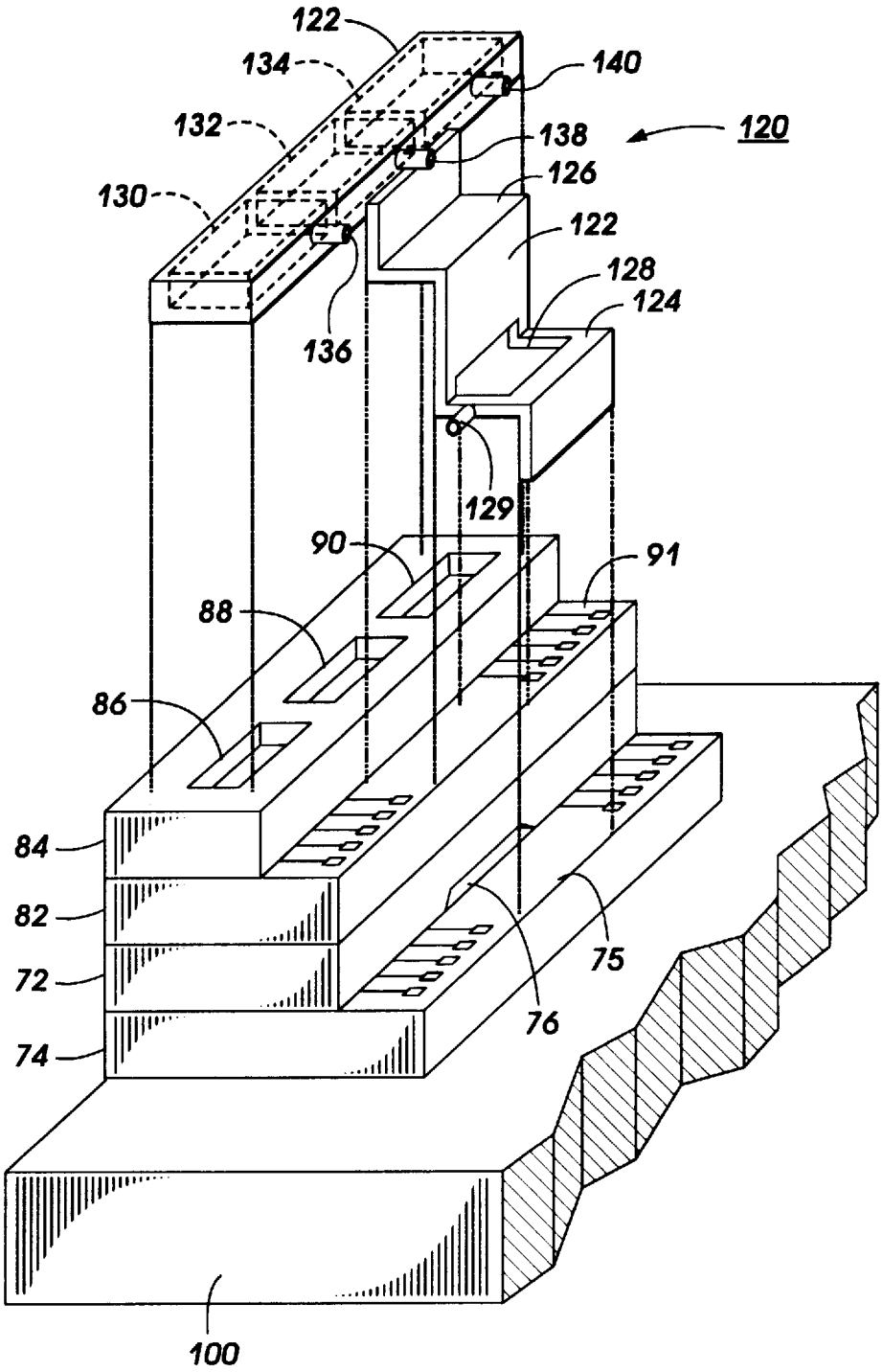
FIG. 10 is a partial view of an ink delivery manifold system for the color printhead of FIG. 8.

A partial view of an ink delivery system 120 is shown in FIG. 10. A stepped manifold 122 has ledges 124, 126 which conform to ledges 75 and 91 of heater substrate 74, 82 respectively, and overlying the area free of the electrode pads. The manifold has opening 128 through which ink flows from a reservoir along the surface of heater substrate 74 and into inlet 76. Black ink is supplied through tube 129. Ink is supplied to inlets 86, 88, 90 from ink compartments 130, 132, 134 respectively. Ink of the appropriate colors are introduced into the internal ink sections through tubes 136, 138, 140.

From the above, it will be appreciated that the black-only printhead 70 will be more effectively cooled than the multi-color printhead 80, since it is directly bonded to the heat sink substrate 100. Some cooling of the multi-color heater substrate 82 will be provided by the black ink in the channel substrate 72 typically, which is separated from it by only a thin layer of adhesive. In addition, the maximum heat load is expected to be less for printhead 80. Multi-color segmented printheads typically have a lower instantaneous maximum printing density than single color die, because typical images do not have 100% cyan, magenta and yellow in close proximity.

To facilitate alignment and bonding of the two printheads 70, 80, a thin layer of adhesive may be used such as, for example, approximately 0.5 micron of Epon. By having such a thin adhesive layer, any non-uniformities in adhesive thickness will have negligible effect on separation distance or parallelism of the rows 87, 89. A further factor affecting separation distance of the nozzle rows is the total thickness of the top heater substrate 82 and the bottom channel substrate 72. Typically the thickness of silicon wafers has a tolerance of 10 microns, so that the combined tolerance could be as much as 20 microns. If that is too much for some applications, it is possible to either specify a tighter tolerance on wafers used for such stacked modules, or alternatively, to match printheads such that the sum of the thicknesses of the top heater substrate 82 and the bottom channel substrate 74 is more nearly constant. To align the stacked printheads laterally, it is possible to dice a precision edge (or edges) on both printheads and butt them into the same reference edge(s). Alternatively, it is possible to align the printhead optically using infrared illumination and optics to see through the silicon. In fact it is possible to bond all four substrates 72, 74, 82, 84 at the wafer level and then dice them apart to form the stacked printhead assembly.

While the embodiments disclosed herein is preferred, it will be appreciated from this teaching that various alternative, modifications, variations or improvements therein may be made by those skilled in the art, which are intended to be encompassed by the following claims:

We claim:

1. An ink jet printer for recording images on a recording medium, the printer comprising:

at least one ink jet printhead formed by bonding a channel substrate having an ink inlet to a silicon heater substrate having a plurality of heater elements located thereon, the channel substrate having grooves formed in the surface bonded to the heater substrate which forms ink channels filled with ink introduced through said inlet, said channels in fluid communication with associated heater elements, the heater substrate having a surface portion extending beyond the channel substrate forming a ledge having an exposed silicon area;

electrical inter-connections between said heater elements and a power source for selectively sending electrical signals to said heater elements, heating the elements and ink in the adjacent channels, causing ink to be ejected from associated nozzles onto the recording medium; and an ink reservoir for supplying ink to said printhead through an ink manifold sealed against the ink inlet, the manifold having an opening formed therethrough, and wherein the ink, as it flows into the ink inlet, directly contacts the exposed silicon surface of the heater substrate, thereby providing cooling of said substrate.

2. A color ink jet printer for recording images on a recording medium, the printer comprising:

at least a first ink jet printhead formed by bonding a channel substrate having an ink inlet to a silicon heater substrate having a plurality of heater elements located therein, the channel substrate having grooves formed in the surface bonded to the heater substrate which form channels filled with ink introduced from said ink inlet, said channels in fluid communication with associated heater elements, the heater substrate having a surface portion extending beyond the channel substrate to form a ledge having an exposed silicon surface;

electrical inter-connections between said heater elements and a power source for selectively sending electrical signals to said heater elements, heating the element and ink in the adjacent channel, causing ink to be ejected from an associated nozzle onto the recording medium;

an ink reservoir for supplying black ink to said first printhead through an ink manifold sealed against the ink inlet, the manifold having an opening formed therethrough so that the ink, as it flows into the ink inlet, directly contacts the exposed silicon surface, thereby providing cooling of said heater substrate;

at least a second ink jet printhead bonded to the top surface of the channel substrate of said first printhead, said second printhead having a plurality of internal groups of ink channels, each ink channel group being in connection with a separate ink inlet formed on the top surface of the second printhead, each group of ink channels terminating in nozzle rows formed on the front face of the second printhead, the second printhead having groups of heating elements positioned within said channel groups;

an ink reservoir and manifold for supplying ink of a selected color into said separate ink inlets of said printhead whereby each group of ink channels is filled with ink of a different color; and electrical inter-connections between said heater element groups of said second printhead and a power source for selectively sending electrical signals to said heater element groups, heating said elements in said groups and heating the ink in the associated channel groups thereby causing ink of a selected color to be ejected from the associated nozzle group onto the recording medium.

3. The printhead of claim 2 wherein said black and color reservoirs are contained in a single-supply assembly, and said black and color inks are supplied to said ink inlets through an integral manifold member.

4. The printhead of claim 2 wherein said first and second nozzle rows are separated by a distance (d) of approximately 1 mm or less.

* * * * *